United States Patent [19]

Manspeaker

[11] 3,995,860

[45] Dec. 7, 1976

[54] ARROWHEAD WITH REMOVABLE BLADES

[76] Inventor: Edward L. Manspeaker, Box 408, R.D. 1, Apollo, Pa. 15613

[22] Filed: Jan. 9, 1976

[21] Appl. No.: 647,659

[52] U.S. Cl. ..... 273/106.5 B; 30/332; 30/339

[51] Int. Cl.[2] ..... F41B 5/02

[58] Field of Search ..... 273/106.5 B; 30/332, 30/337, 339, 329, 303

[56] References Cited

UNITED STATES PATENTS

| | | | |
|---|---|---|---|
| 2,909,372 | 10/1959 | Neri | 273/106.5 B |
| 2,912,247 | 11/1959 | Doonan | 273/106.5 B |
| 2,940,758 | 6/1960 | Richter | 273/106.5 B |
| 3,614,103 | 10/1971 | Carroll | 273/106.5 B |
| 3,741,542 | 6/1973 | Karbo | 273/106.5 B |
| 3,854,723 | 12/1974 | Wilson | 273/106.5 B X |
| 3,887,186 | 6/1975 | Matlock, Jr. | 273/106.5 B |

*Primary Examiner*—Paul E. Shapiro
*Attorney, Agent, or Firm*—Carothers and Carothers

[57] ABSTRACT

A readily disassembled hunting arrowhead having a main cutting blade having a forward point and an axially aligned opening therethrough to receive a tubular retaining ferrule in axial alignment with the blade. A main ferrule is provided with a forward surface to fit the inner sides of the retaining ferrule upon axial insertion of the forward end of the main ferrule into the tubular retaining ferrule. The mating surfaces of the two ferrules are preferably forwardly tapered. The forward end of the main ferrule is provided with a transverse slot to receive the main blade and the rearward end of the main ferrule is provided with an arrow shaft attaching socket. The arrowhead is assembled by inserting the retaining ferrule in the aforesaid axially aligned opening of the main blade such that it is received in axial alignment with the main blade and the forward end of the main ferrule is then forwardly and axially inserted into the tubular retaining ferrule as the slot of the main ferrule receives the main blade therein. The interengagement between the tubular ferrule and main ferrule causes the slotted forward end of the main ferrule to compress and embrace the main blade. The interengaging parts are preferably cemented with a thermosetting cement which loses its adhesion properties upon application of a low heat flame for disassembly of the arrowhead. A second removable blade may be provided in axial alignment with and at right angles to the main blade. The second blade is attached or withdrawn by passing the same through a second opening in the main blade.

11 Claims, 8 Drawing Figures

ARROWHEAD WITH REMOVABLE BLADES

BACKGROUND OF THE INVENTION

1. Field of the Invention

The present invention relates to archery equipment and more particularly to arrowhead constructions.

2. Description of the Prior Art

Hunting arrowheads of the prior art have a disadvantage in that most of them are not readily disassembled and they require spot welding or brazing at assembly such that the parts cannot be readily changed if required. In addition, those hunting arrowheads of the prior art which may be disassembled (for example, see U.S. Pat. No. 3,741,542) have main blades which are generally designed such that they are in a U- or V-shaped configuration having open legs at the rearward extent of the blade. Such blades tend to warp and bend during hardening processes and in welding and brazing operations.

It is the principle object of the present invention to eliminate these disadvantages and to provide a readily disassembled arrowhead which requires no welding or brazing for assembly and which may further be disassembled with the application of a low heat flame.

SUMMARY OF THE INVENTION

The hunting arrowhead of the present invention overcomes the aforementioned disadvantage by providing an arrowhead having a novel interconnecting means for greater ease of assembly and disassembly, which is further characterized in that the assembly is more secure than those of the prior art, and further holds the blade or blades, as the case may be, in accurate predetermined alignment with the arrow shaft.

The readily disassembled arrowhead of the present invention comprises, in its simplest form, a flat cutting main blade with a forward point and an axially aligned opening in the main blade which is adapted to receive a hollow tubular retaining ferrule in axial alignment therewith. A main ferrule is also provided and is substantially an elongated member having a forward surface which fits the inner sides of the tubular retaining ferrule upon forward axial insertion of the main ferrule into the tubular retaining ferrule. It is preferable that the mating surfaces of the tubular ferrule and the main ferrule be forwardly tapered such that when the forward end of the main ferrule is inserted into the tubular retaining ferrule and engages the internal sides thereof, the main ferrule is inwardly compressed. The main ferrule is provided with a transverse slot extending rearwardly from the front or forward end thereof in order to slide over the opposite sides of the main blade and thereby support the main blade in the main ferrule as the tubular retaining ferrule is received in the axial opening in the main blade, all three members being joined together in axial alignment. The more force which is applied to the main ferrule to thrust it further into the tubular retaining ferrule, the greater is the inward compression force applied by the tubular retaining ferrule to the main ferrule which increases the clamping effect of the main ferrule on the opposite sides of the main blade. The interengaging parts are then preferably cemented together with a thermosetting ferrule cement which may be readily softened for disassembly of the arrowhead by the application of heat to the arrowhead assembly such as by a low heat flame from a match. For this reason, the use of all metal parts is preferable, but it is obvious that, other than the blade or blades, the arrowhead assembly may be constructed of any suitable material such as plastic.

The arrowhead of the present invention has further novelty in the provision of a second blade which also may be readily removed. The second blade is somewhat smaller than the first cutting blade and comprises a forward tip and rearwardly and laterally extending spaced cutting side legs. It is thus an open blade construction wherein the rearward and laterally extending side legs terminate in inner opposed end edges which engage and fit the outer sides of either the tubular retaining ferrule or the main ferrule as desired for alignment. This second blade passes through a second opening in the main blade which is positioned between the point of the main blade and the aforementioned first axially aligned opening.

The arrowhead is provided with means to maintain the second blade at right angles to the main blade and to further maintain the second blade in axial alignment with the remainder of the arrowhead. Either the tubular retaining ferrule or the main ferrule, or both, or a combination of these two ferrules, are provided with alignment recesses or slots to maintain the two blades in proper position with respect to each other.

Additional alignment means for positioning the point or tip of the second blade is also preferably provided by shaping the second opening through which the second blade passes through the main blade such that this opening is in the form of a circle with two opposed partial quarter-quadrants remaining. These partial quarter-quadrants are positioned and shaped such that after the second blade is inserted through the second opening and properly positioned, these quarter-quadrants provide edges which define offset parallel spaced sides in the second opening of the main blade to engage the opposite sides of the second blade when in position and thereby hold the point of the second blade in axial alignment.

In addition, it is also preferable that the first-mentioned opening in the main blade which receives the tubular retaining ferrule have contours which fit the outside contours of the tubular retaining ferrule to maintain the latter in correct axial alignment.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE PREFERRED EMBODIMENT

Figure 1:
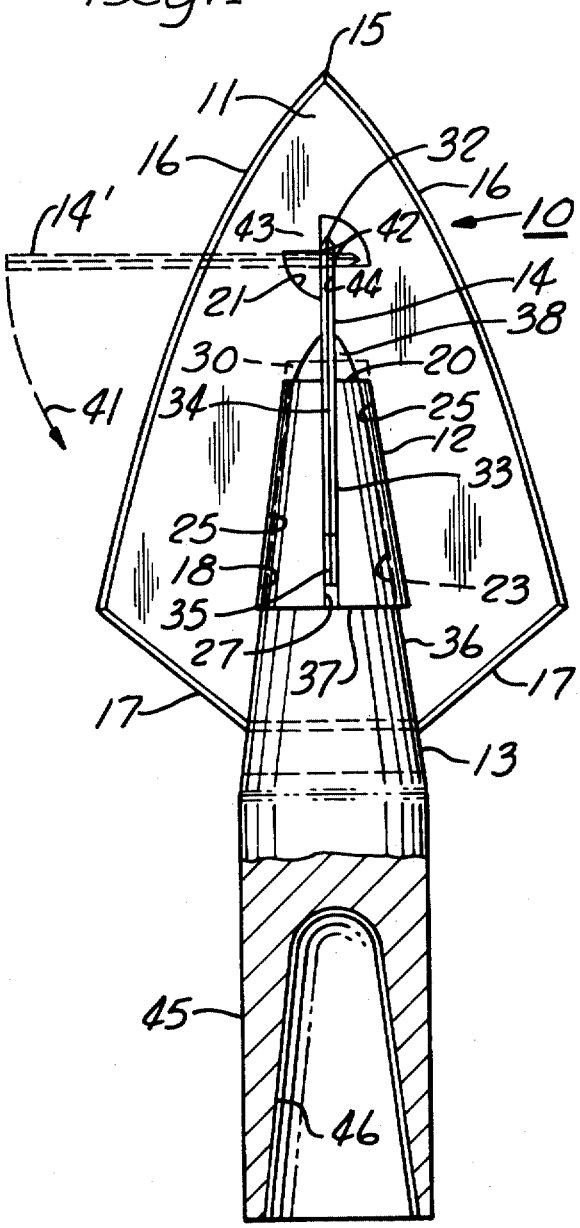
FIG. 1 is a view in side elevation facing the flat side of the main blade of one embodiment of the arrowhead of the present invention.
Figure 2:
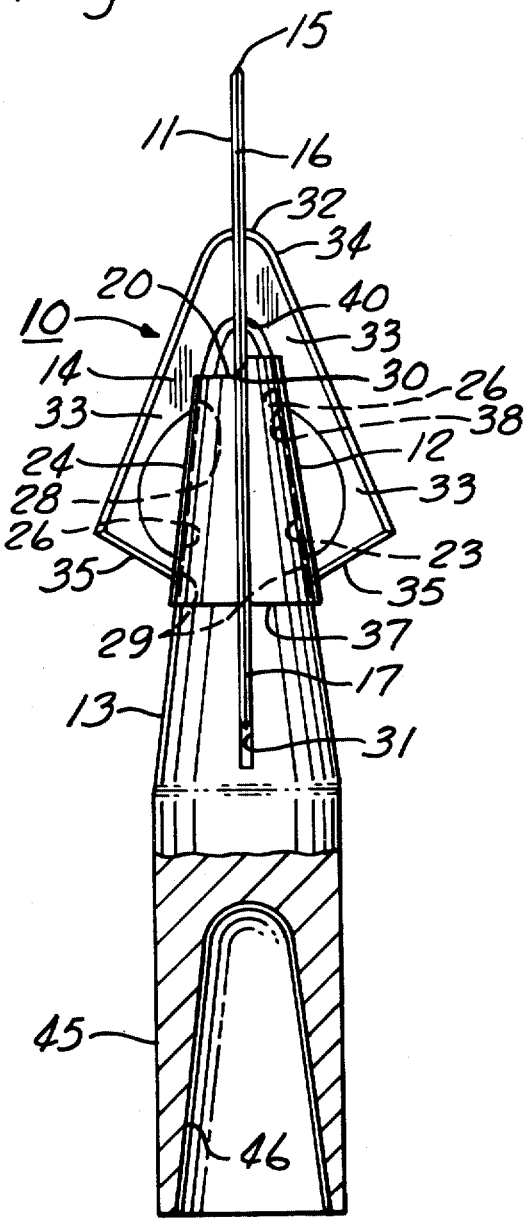
FIG. 2 is a similar view of the arrowhead of the present invention at right angles to the structure shown in FIG. 1.
Figure 4:
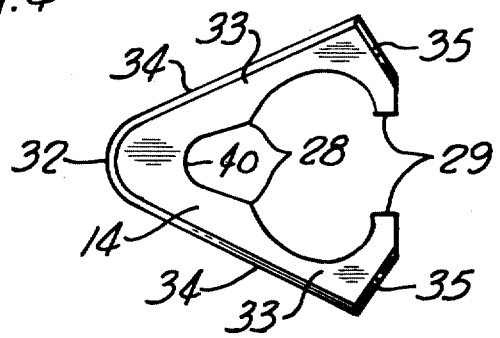
FIG. 4 is an independent view of the flat side of the smaller secondary blade of the arrowhead construction illustrated in FIGS. 1 and 2.

FIGS. 1 and 2 illustrate the assembled preferred embodiment of the hunting arrowhead of the present invention and FIGS. 4 through 6 illustrate the readily disassembled arrowhead structure of FIGS. 1 and 2 in disassembled form. Referring with particular reference first to FIGS. 1 and 2, the arrowhead structure 10 is illustrated in assembled form and comprises an assembly of four independent parts. These parts consist of the main cutting blade 11, the tubular retaining ferrule 12, the main ferrule 13, and the second smaller cutting blade 14. The readily disassembled arrowhead of the present invention in its simplest form need only consist of the main cutting blade 11, the retaining ferrule 12 and the main ferrule 13. The second blade 14 may be omitted, and while it is not an essential combination of the arrowhead structure of the present invention, additional novelty is provided by its addition, together with the means utilized to mount and align the second cutting blade.

The main cutting blade 11 is provided with a forward point 15 and has opposed and rearwardly extending cutting side edges 16. Cutting blade 11 is also provided with sharpened rear cutting edges 17. Cutting edges 17 are not required for penetration of the arrowhead into the target, but they are merely provided to give assistance in removing the arrowhead once it has penetrated the target.

Figure 3:
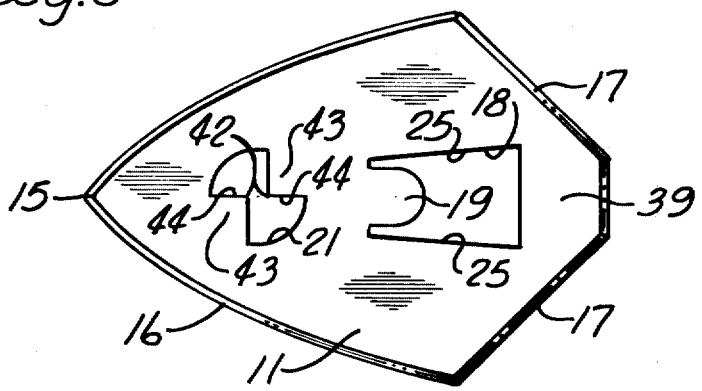
FIG. 3 is an independent view of the flat side of the main blade of the arrowhead assembly illustrated in FIGS. 1 and 2.

With additional reference to FIG. 3, main arrowhead 11 is also provided with an axially aligned opening 18 which is shaped to receive and fit the outside contours of the tubular retaining ferrule 12.

With particular reference to FIG. 3, internal support projection 19 is left remaining in opening 18. Thus, when the tubular retaining ferrule 12 is axially mounted and centered within opening 18 of main blade 11, projection 19 projects down into the forward open end 20 of retaining ferrule 12 to give more positive support to the main blade 11 when the arrowhead is completely assembled.

Main blade 11 is also provided with a second opening 21 therethrough to receive second blade 14 and to also keep or maintain the tip 32 of second blade 14 axially aligned, as will be hereinafter further explained.

Figure 5A:
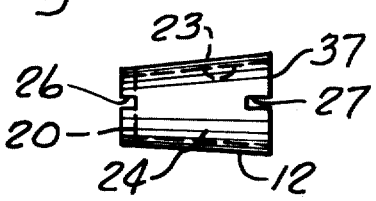
FIG. 5*a* is an independent view of the tubular retaining ferrule illustrated in FIG. 1.
Figure 5B:
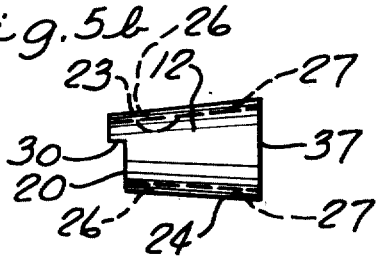
FIG. 5*b* is an independent view of the tubular retaining ferrule illustrated in FIG. 2.

Tubular retaining ferrule 12 is illustrated here as a frusto-conical tubular body having forwardly and inwardly tapered inner surface 23 (as best illustrated in FIGS. 5*a* and 5*b*) and an outer frusto-conical surface 24, which at diametrically opposed points mates the inner opposed side edges 25 of the axially aligned opening 18 when the retaining ferrule 12 is inserted therein.

Tubular retaining ferrule 12 is provided with diametrically opposed or aligned forward recesses or slots 26 and rear recesses or aligning slots 27. Forward alignment slots 26 are adapted to receive the two opposed inner shoulders 28 respectively of second blade 14 which is independently illustrated in FIG. 4. Rear slots 27 of tubular retaining ferrule 24 are adapted to receive the inner opposed end edges 29 of second blade 14 for additional alignment and so secure the second blade 14 in place as the inner opposed end edges 29 snap fit into the respective slots or recesses 27 to retain second blade 14 in position.

In order to maintain second blade 14 at right angles with main blade 11, the forward end 20 of retaining ferrule 24 is also provided with a centering ledge 30 which provides a flat face for engagement with the face or side of main blade 11 thereby maintaining second blade 14 at right angles with main blade 11 because the axially extending face of the centering ledge 30 lies in a plane which extends at right angles to the plane of opposed slots 26 and 27.

It is obvious that alternative recess or slot alignment means may be provided to maintain the two blades at right angles. For example, the smaller blade or second blade 14 may be designed such that slots 26 and 27 in retaining ferrule 12 would actually be recesses made in the forward portion of the main ferrule 13. In other words, alignment slots for second blade 14 may be provided in the main ferrule 13 as opposed to providing all or part of them in the tubular retaining ferrule 12. The second blade 14 is then held at right angles and in axial alignment with main blade 11 as such recesses or slots which might be inserted in the main ferrule would be positioned in a plane at right angles to slot 31 of main ferrule 13 which receives main blade 11. In any event, either means of maintaining the blades axially aligned and at right angles is referred to generally hereinafter as slot or recess alignment means.

With further specific reference to second blade 14 of FIG. 4, this smaller blade consists generally of the forward tip 32 and rearwardly and laterally extending spaced cutting side legs 33, which of course terminate to the inner opposed end edges 29. The side legs 33 from the tip 32 are provided with a sharpened cutting edge 34. Also, the rear or trailing edges 35 of legs 33 are also sharpened for the same reasons that the trailing edges 17 of blade 11 are sharpened, e.g., to permit ease of removal of the assembled arrowhead when being withdrawn from the target.

Figure 6A:
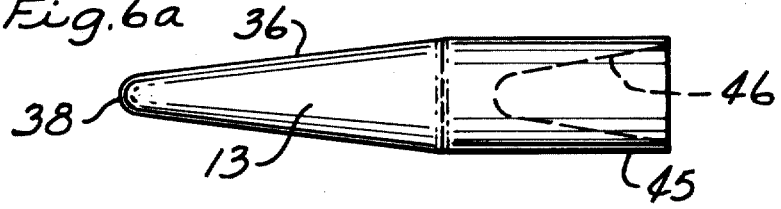
FIG. 6*a* is an independent view of the main ferrule illustrated in the arrowhead construction of FIG. 1.
Figure 6B:
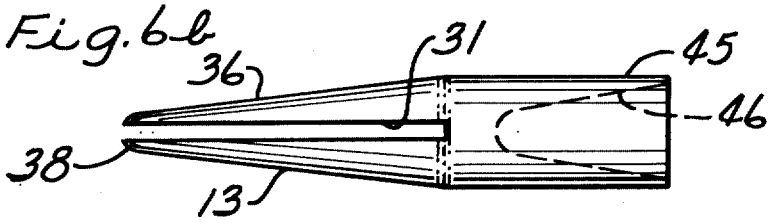
FIG. 6*b* is an independent view of the main ferrule of the arrowhead construction illustrated in FIG. 2.

Referring next to the main ferrule 13 as illustrated in FIGS. 1 and 2 and independently in FIGS. 6*a* 6*b*, the elongated ferrule consists of an inwardly and forwardly tapered forward end 36 which provides a frusto-conical surface which will mate the internal frusto-conical surface 23 of tubular retaining ferrule 12 when the forward end 36 of main ferrule 13 is axially inserted into the rear opening 37 of tubular retaining ferrule 12.

Main ferrule 13 is provided with a transverse slot 31 which extends rearwardly from the forward end 38 of main ferrule 13 to receive and slide over the opposite sides of main blade 11 and support the main blade 11 in the main ferrule 13 as the tubular retaining ferrule is positioned or received in axial opening 18 of main blade 11.

It can thus be readily observed that the arrowhead structure of the present invention is assembled by first inserting tubular retaining ferrule 12 into opening 18 so that it is axially centered within the opening 18. This is accomplished by first inserting projection 19 of main blade 11 into the forward opening 20 of retaining ferrule 12 and then positioning the remainder of tubular ferrule 12 within the opening 18 so that it is axially aligned with blade 11. In accomplishing this, the centering ledge 30 must be positioned so that the ledge surface which extends in the same direction as the axis of the arrowhead lies flush against one face of the main cutting blade 11. In this regard, it should be noted that centering ledge 30 is offset from the axis of the retaining ferrule 12 to compensate for the thickness of main blade 11 such that all parts will maintain the proper axial alignment.

Once this has been accomplished, the forward end 38 of main ferrule 13 will be moved such that the rear webbed portion 39 of main blade 11 is received in slot 31. Main ferrule 13 is then urged further axially into and on through the frusto-conical interior of tubular retaining ferrule 12. As the forward end 38 of main ferrule 13 passes on through tubular retaining ferrule 12 and on out the forward open end 20 thereof, projection 19 is also received in the forward end of slot 31 of the main ferrule. Main ferrule 13 is axially urged forward into tubular retaining ferrule 12 until it can go no farther and attains the locked resting position as illustrated in FIGS. 1 and 2, whereby the inner tapered surface 23 of tubular retaining ferrule 12 and the mating outer frusto-conical surface 36 of main ferrule 13 are engaged such that the forward tapered end 36 of main ferrule 13 is compressed by the retaining ferrule to tend to close slot 31 and thereby tightly engage and grip the main blade 11 between the split forward halves of the main ferrule.

Accordingly, any impact which might be applied to the tip 15 of main blade 11 even further tightens the arrowhead assembly, rather than to create a situation to weaken the assembly.

It is also preferred that all the interengaging parts between tubular retaining ferrule 12, main ferrule 13 and main blade 11 be cemented together with a thermosetting ferrule cement. The parts are then readily disassembled by the application of heat such as by a low heat flame from a match.

Second blade 14, if desired in the assembly, is then mounted to the arrowhead by passing one of the opposed end edges 29 of legs 33 through second opening 21 of main blade 11 as the second blade 14 is held in a position or plane which is at right angles to the plane of main blade 11 and at right angles also to the axis of the arrowhead assembly as indicated by the dashed outline 14' of second blade 14 in FIG. 1.

In this manner, one leg 33 of second blade 14 is passed all the way through second opening 21 until that portion of second blade 14 in the area of tip 32 and recess 40 is positioned within opening 21. Second blade 14 is then swung downwardly or rearwardly as indicated by arrow 41 in FIG. 1 such that the blade pivots about internally opposed corners 42 until small or second blade 14 is in a plane that is aligned with the axis of the arrowhead structure and so that the blade is also aligned with its retaining recesses or slots 26 and 27 in retaining ferrule 12. At this point, second blade 14 is then urged rearwardly so that the rearward opposed edges 28 will slide over the outside surface of retaining ferrule 12 and snap down into their respective slots or recesses 27 while shoulders 28 of second blade 14 mesh into their corresponding foward slots 26 of the retaining ferrule.

It should be noted that second opening 21 in main blade 11 is generally in the configuration of a circle with two partial quadrants 43 remaining. These partial quadrants 43 are obviously not made full quadrants in order to allow for the thickness of the second blade 14 which must pass between the quadrants of opening 21. When second blade 14 is thus finally positioned as illustrated in FIG. 1, the offset parallel spaced sides 44 of partial quadrants 43 engage the opposite sides of the tip portion of second blade 14 and hold the point or tip thereof in axial alignment.

The rearward end 45 of main ferrule 13 is provided with arrow shaft attaching socket 46 to receive the forward end of an arrow shaft (not shown) which is secured in the socket by an appropriate cement.

I claim:

1. A readily disassembled arrowhead, comprising a main flat cutting blade with a forward point rearwardly and laterally extending cutting side edges, a tubular retaining ferrule, means defining an axially aligned opening in said blade to receive said ferrule in axial alignment therewith, a main ferrule having a forward surface to fit the inner sides of said retaining ferrule upon axial insertion of the forward end of the latter into said retaining ferrule, means defining an arrow shaft attaching socket in the rear or said main ferrule, and means defining a transverse slot extending rearwardly from the forward end of said main ferrule to slide over the opposite sides of said blade and support the latter in said main ferrule as said retaining ferrule is received in said axial opening.

2. The structure of claim 1, which also includes a second opening in said main blade between said point and said first opening therein, a second and smaller flat cutting blade passing through said second opening and having a forward tip and rearwardly and laterally extending spaced cutting side legs each with inner opposed end edges to engage and fit the outer sides of one of said ferrules.

3. The structure of claim 2, which also includes axial alignment means in opposite sides of at least one of said ferrules to receive said second blade in axial alignment at right angles to said main blade.

4. The structure of claim 3, wherein said alignment means includes aligned recess means in opposite sides of the rearward end of said retaining ferrule to receive said inner end edges.

5. The structure of claim 4, wherein said alignment means includes aligned slot means in opposite forward sides of said retaining ferrule to receive said second blade for alignment.

6. The structure of claim 4, wherein said alignment means includes alignment centering means on the forward end of said retaining ferrule to receive and hole said main blade at right angles to said aligned recess means.

7. The structure of claim 2, which also includes offset planes defining spaced inwardly directed edges in said second opening of said main cutting blade to engage the opposite sides of said second blade and hold the point thereof in axial alignment.

8. The structure of claim 1, which also includes a meltable cement engaging the interengaging surfaces of said retaining ferrule and the mating surfaces of said main ferrule to permit disassembly of said arrowhead with the application of heat.

9. The structure of claim 1, wherein the inner surface of said retaining ferrule and outer forward surface of said main ferrule are forwardly tapered to mate upon insertion of the forward end of said main ferrule into said tubular retaining ferrule to compress said slotted forward end and thereby embrace said main blade.

10. The structure of claim 1 wherein said opening fits the outside contours of said retaining ferrule when positioned therein for assembly.

11. An arrowhead consisting of a flat blade with a leading sharpened point and sharpened perimetral cutting edges extending rearwardly from its leading point, means defining an opening of predetermined configuration through said blade centered axially of its leading point and the axis of said arrowhead, a tubular ferrule, the outer symmetrical sides of which fit the inner edges of said opening, a projectile-shaped body having a transverse slot to embrace the sides of said blade when passed through said ferrule and lock it with said blade and to said projectile-shaped body, an arrow shaft socket in the rear of said projectile-shaped body positioned axially of said blade point and said arrowhead, and a cement holding the interengaging parts of said arrowhead together, which cement is readily melted by a low temperature flame applied thereto to disassemble the parts of the arrowhead.

* * * * *